US005201828A

United States Patent [19]

Martin

[11] Patent Number: 5,201,828

[45] Date of Patent: Apr. 13, 1993

[54] INTERLOCKING TRAY AND COVER ARRANGEMENT

[75] Inventor: Roger L. Martin, San Jose, Calif.

[73] Assignee: Container Corporation of America, Clayton, Mo.

[21] Appl. No.: 884,386

[22] Filed: May 18, 1992

[51] Int. Cl.[5] ..... B65D 5/68; B65D 43/06

[52] U.S. Cl. ..... 229/125.27; 206/45.34; 229/125.26; 229/162

[58] Field of Search ..... 229/125.25, 125.26, 229/125.27, 125.29, 162, 114; 206/45.31, 45.34; 220/306, 352, 356

[56] References Cited

U.S. PATENT DOCUMENTS

| | | | |
|---|---|---|---|
| 2,683,561 | 7/1954 | Rice | 229/125.28 |
| 3,010,638 | 11/1961 | Forrer | 229/125.26 |
| 3,110,436 | 11/1963 | Wagner | 229/125.26 |
| 3,258,187 | 6/1966 | Greatman | 229/125.26 |
| 3,410,475 | 11/1968 | Wagner | 229/125.29 |
| 3,670,881 | 6/1972 | Dutcher | 229/125.26 |
| 3,716,164 | 2/1973 | Fennema | 206/45.34 |
| 3,795,360 | 3/1974 | Bianchi et al. | 229/125.27 |
| 3,837,526 | 9/1974 | Medendorp | 206/45.34 |
| 3,957,097 | 5/1976 | Swett | 220/356 |
| 4,258,875 | 3/1981 | Sykora | 229/125.26 |
| 4,298,133 | 11/1981 | Davis | 220/306 |
| 4,428,497 | 1/1984 | Julius et al. | 220/306 |
| 4,877,178 | 10/1989 | Eisman | 229/125.28 |
| 4,966,294 | 10/1990 | Mack et al. | 220/356 |
| 5,076,459 | 12/1991 | Dehart | 220/306 |

FOREIGN PATENT DOCUMENTS

| | | | |
|---|---|---|---|
| 2652566 | 4/1991 | France | 229/125.29 |

*Primary Examiner*—Gary E. Elkins
*Attorney, Agent, or Firm*—Richard W. Carpenter

[57] ABSTRACT

An interlocking tray and cover arrangement especially suitable for packaging food products. The arrangement includes a paperboard, tray member having laterally outward extending projections at the upper ends of certain of its side walls which projections are adapted to be releasably received within a peripheral groove located at a lower portion of a molded plastic cover member.

4 Claims, 2 Drawing Sheets

INTERLOCKING TRAY AND COVER ARRANGEMENT

BACKGROUND OF THE INVENTION

1. Field of the Invention

This invention relates to packages of the type used to package food products, such as berries, and more particularly to a composite, two-piece, package comprising a paperboard tray and interlocking plastic cover.

2. Description of Background Art

A background art search directed to the subject matter of this application conducted in the U.S. Patent and Trademark Office disclosed the following U.S. Pat. Nos.:

| | | | |
|---|---|---|---|
| 1,725,173 | 2,316,457 | 3,027,062 | 3,191,846 |
| 3,410,475 | 3,795,360 | 3,926,362 | 4,339,068 |
| 4,362,265 | 4,431,128 | 4,444,354 | 4,470,538 |
| 4,474,324 | 4,742,934 | 4,856,707 | 4,877,178 |
| 4,930,681 | and Canadian Letters Patent Number 873,183 | | |

None of the patents uncovered in the search discloses an interlocking tray and cover arrangement, especially suitable for packaging food products, which includes a paperboard tray having laterally outwardly extending projections at the upper ends of certain of its side walls, which projections are adapted to be releaseably received within a peripheral groove located at a lower portion of a molded plastic cover.

SUMMARY OF THE INVENTION

A primary object of the present invention is to provide a package having an interlocking tray and cover arrangement that is especially suitable for packaging food products.

A more specific object of the invention is to provide a composite package including a paperboard tray having laterally outwardly extending projections at the upper ends of certain of its side walls which projections are adapted to be releaseably received within a peripheral groove located at a lower protion of a molded plastic cover.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
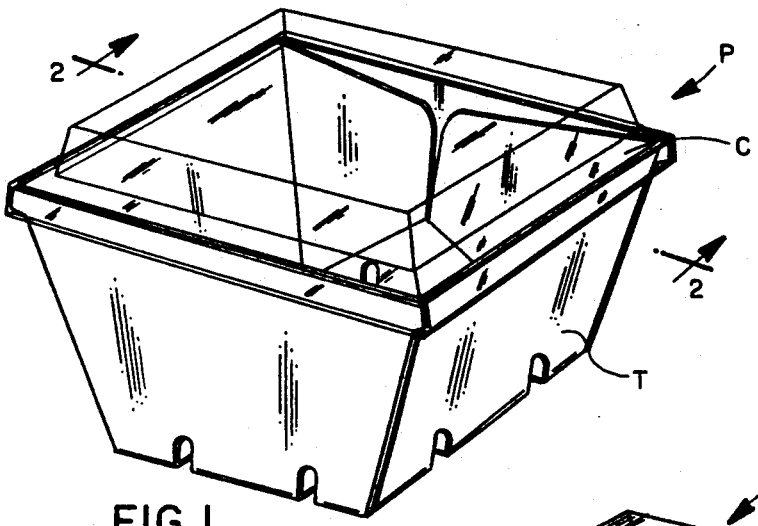
FIG. 1 is an isometric view of a composite package embodying features of the present invention.

Turning now to the drawings for a better understanding of the invention, it will be seen that the package P illustrated in FIG. 1 is a composite package that includes a preferably paperboard tray member, indicated generally at T, and a clear, molded plastic, cover member, indicated generally at C. The tray and cover members have interlocking engagement with each other as described later in the specification.

Figure 2:
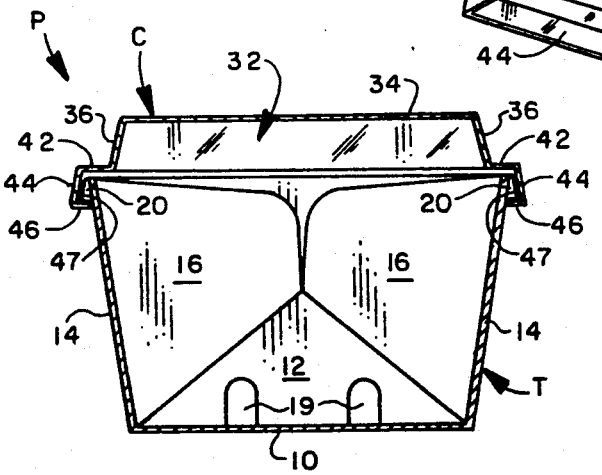
FIGS. 2 is a fragmentary vertical sectional view taken on line 2—2 of FIG. 1.
Figure 4:
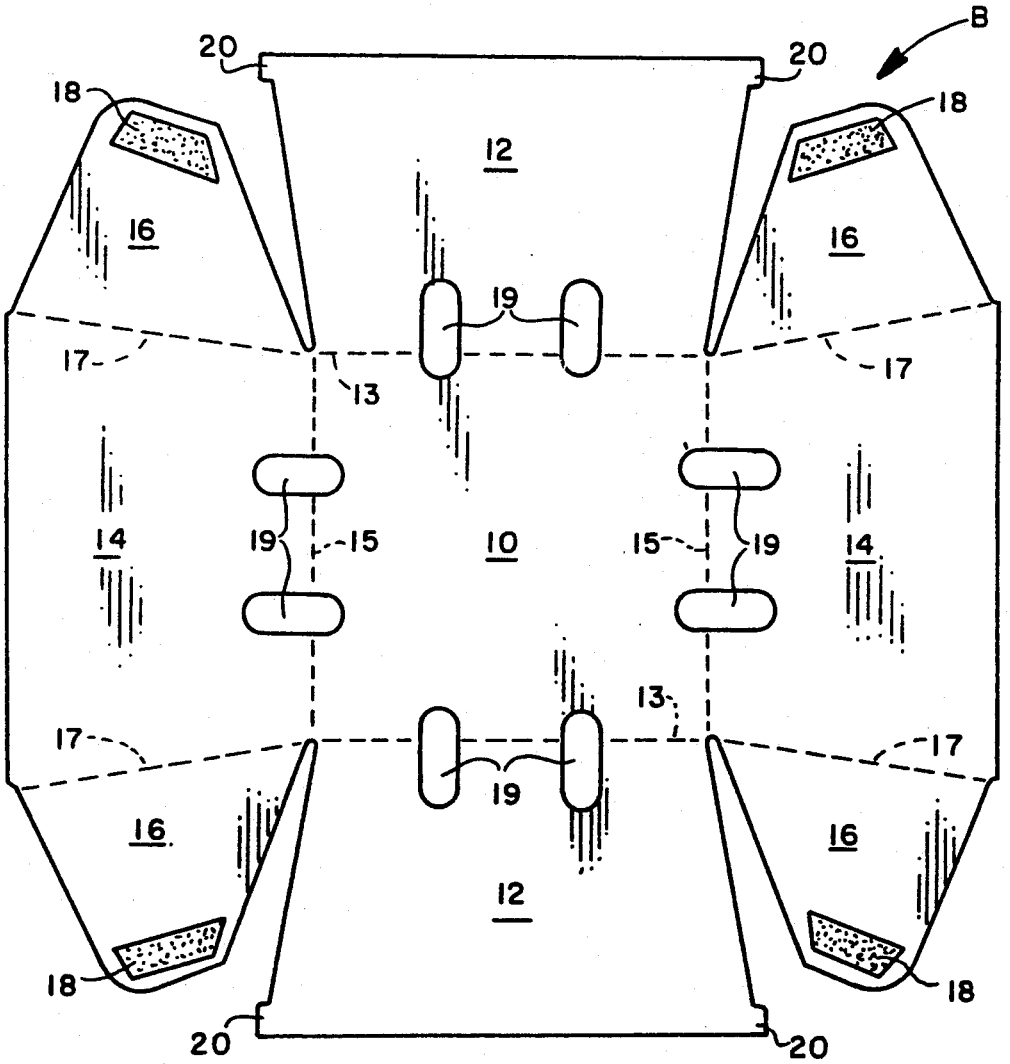
FIG. 4 is a plan view of a blank of a foldable sheet material from which the tray member illustrated in the previous views may be formed.

Referring now in FIGS. 1, 2, and 4, it will be seen that the tray member T may be formed from a unitary blank B of foldable sheet material, such as paperboard, as illustrated in FIG. 4.

The tray member T includes a preferably generally rectangular bottom wall panel 10 having a pair of opposed first side wall panels 12, foldably joined to a pair of opposed side edges of bottom wall panel 10, along fold lines 13, and a pair of opposed second side wall panels 14, foldably joined along fold lines 15 to another pair of opposed side edges of bottom wall panel 10.

The first and second side wall panels are disposed to extend upwardly and outwardly from bottom wall panel 10, and are connected to each other at the corners of the tray be means of glue panels 16 which are foldably joined to opposite ends of second side wall panels 14 along fold line 17. They may be attached to the related first side wall panels 12 by adhesive applied in the areas indicated at 18.

If desired, the lower corners of the tray member T may be provided with a plurality of vent openings 19.

As best seen in FIGS. 2 and 4, tray member first side wall panels 12 are provided at their upper corners with outwardly projecting lock tabs 20 which are adapted to be received within a complementary groove of the cover member to provide interlocking engagement therebetween, as described later in the specification.

Figure 3:
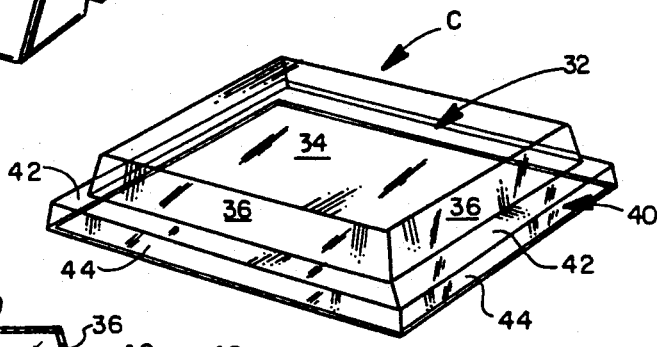
FIG. 3 is an isometric view of the cover member illustrated in the previous views.

Turning now to FIG. 3, it will be seen that the cover member, indicated generally at C, includes a domed shaped center portion 32 comprising a generally rectangular top wall 34 having a plurality of side walls 36 depending therefrom.

Cover member C also includes, at its lower end, a hollow, peripheral flange 40, which is formed integrally with the lower edges of the center portion side walls. Flange 40 includes a top wall 42, pairs of opposed side walls 44 depending therefrom, and a bottom wall 46 extending inwardly from lower edges of side walls 44 to define an inwardly facing, peripheral groove 47.

As best seen in FIG. 2, the contour of groove 47 is similar to the contour of tray member lock tabs 20 in order to provide a snug interlocking, but readily releaseable, engagement between the cover member and the tray member.

Although the lock tabs 20 are located on the upper corners of first side walls 12, as illustrated in FIG. 4, this arrangement may be modified as hereinafter described.

Figure 5:
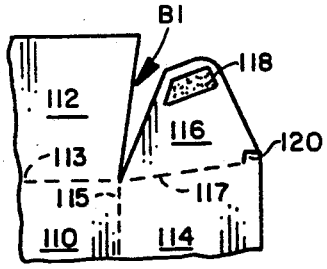
FIG. 5 is a fragmentary plan view similar to FIG. 4, but illustrating a modified form of the invention.
Figure 6:
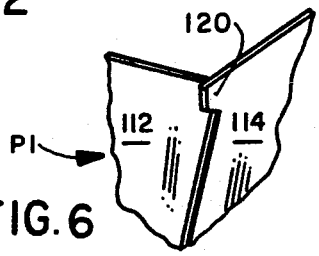
FIG. 6 is a fragmentary isometric view illustrating the corner construction of an erected tray member using the arrangement illustrated in FIG. 5.

FIGS. 5 and 6 illustrate a slightly modified form of the invention wherein lock tabs 120 are provided on the corners of second side wall panels 114. When the tray is erected, as illustrated in FIG. 6, the same type of interlocking engagement is provided between the tray and cover members.

Figure 7:
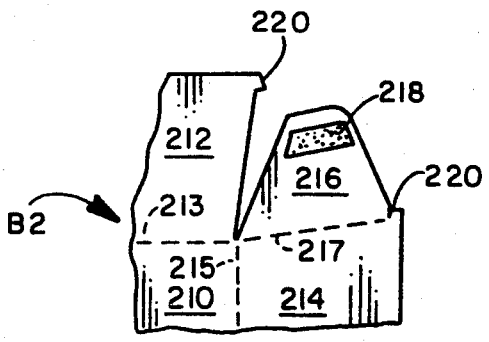
FIGS. 7 and 8 are views similar to FIGS. 5 and 6, respectively, but illustrate yet another modified form of the invention.
Figure 8:
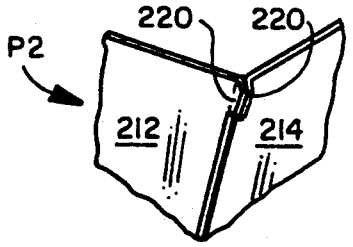

In FIGS. 7 and 8, yet another modification of the invention is shown. In this embodiment both first side wall panels 212 and second side wall panels 214 are provided with lock tabs 220. Again, the interlocking engagement between the cover and tray members is the same as that described in connection with the previously described embodiments.

Thus, it will be appreciated that the invention provides a unique, attractive, sanitary, composite package that is especially suitable for the packaging of food products, and which comprises a paperboard tray member having interlocking engagement with a preferably clear, molded plastic, cover member.

What is claimed is:

1. A combination interlocking tray and cover arrangement, comprising:

(a) a tray member formed from a unitary blank of foldable sheet material and including a generally rectangular bottom wall panel and opposed pairs of side wall panels foldably joined to opposed side edges of said bottom wall panel and extending upwardly and outwardly therefrom;

(b) said side wall panels being foldably joined to each other to form, with said bottom wall panel, an open top structure;

(c) certain of said side wall panels having, adjacent upper ends thereof, laterally outward extending projections arranged and disposed for readily releasable interlocking engagement within a complementary channel of a separate cover member;

(d) said cover member being a generally rectangular domed structure formed of molded plastic material;

(e) said cover member having a hollow, central, raised portion, including a top wall with side walls extending downwardly and outwardly therefrom to form therewith said domed structure, and a peripheral flange formed integrally with said center portion;

(f) said flange including:

(i) an upper wall extending outwardly from lower edges of said center portion side walls;

(ii) pairs of opposed flange side walls extending downwardly from outer edges of said upper wall;

(iii) a lower wall extending inwardly from lower edges of said flange side walls and forming with said flange side walls and upper wall an enclosed, internal, peripheral channel arranged and and disposed to releasably receive said tray member projections in interlocking engagement therewith.

2. An arrangement according to claim 1, wherein all of said cover member walls are flat.

3. An arrangement according to claim 1, wherein said cover member is transparent.

4. An arrangement according to claim 1, wherein said tray member projections have horizontally extending lower edges which are arranged and disposed for engagement with said cover member flange lower walls to retain said cover member in place on said tray member.

* * * * *